US005402535A

United States Patent [19]

Green

[11] Patent Number: 5,402,535

[45] Date of Patent: Apr. 4, 1995

[54] RESTRAINING INFLATABLE NECK GUARD

[75] Inventor: Jeffrey C. Green, Edwardsville, Ill.

[73] Assignee: CONAP, Inc., Fort Worth, Tex.

[21] Appl. No.: 165,988

[22] Filed: Dec. 13, 1993

Related U.S. Application Data

[63] Continuation-in-part of Ser. No. 972,130, Nov. 5, 1992, abandoned.

[51] Int. Cl.[6] ..... A41D 13/00

[52] U.S. Cl. ..... 2/2; 2/6.2; 2/413; 2/415; 2/DIG. 3; 128/DIG. 23

[58] Field of Search ..... 2/2, 413, 415, 6.2, 2/DIG. 3, DIG. 10; 280/730 R, 733, 739; 128/DIG. 23; 602/13

[56] References Cited

U.S. PATENT DOCUMENTS

| | | | |
|---|---|---|---|
| 3,527,475 | 9/1970 | Carey et al. | 280/739 |
| 3,645,259 | 2/1972 | Schulman | 2/6.2 X |
| 3,765,412 | 10/1973 | Ommaya et al. | 128/DIG. 23 X |
| 3,941,404 | 3/1976 | Otaegui-Ugarte | 280/733 |
| 5,060,661 | 10/1991 | Howard | 602/13 X |
| 5,287,562 | 2/1994 | Rush, III | 2/413 |

*Primary Examiner*—Peter Nerbun
*Attorney, Agent, or Firm*—Arthur F. Zobal

[57] ABSTRACT

The restraining inflatable neck guard is adapted to be located around a person's neck when deflated. A source of compressed gas is coupled to the neck guard for inflating the guard. A normally closed electrically actuated valve is provided for releasing the compressed gas from the source for flow to the inflatable neck guard when actuated. A sensor is provided for sensing acceleration/deceleration forces in three mutually perpendicular directions and for producing electrical outputs having levels which are proportional to the forces sensed. A threshold device compares the electrical outputs with a threshold to actuate the valve when either of the electrical outputs reaches the threshold. The sensor may be employed to sense acceleration/deceleration forces in one direction only. Aircraft or vehicle systems may be used to initiate the inflation sequence. The restraining inflatable neck guard is designed to maintain distance between the neck and collar throughout the inflation process. The use of strength bars and shape molding spars provide controlled inflation of the inflatable neck guard.

19 Claims, 9 Drawing Sheets

RESTRAINING INFLATABLE NECK GUARD

This application is a continuation-in-part of application Ser. No. 07/972,130, filed Nov. 5, 1992, now abandoned.

FIELD OF THE INVENTION

The invention relates to a restraining inflatable neck guard for protecting a person in the event of rapid acceleration/deceleration.

BACKGROUND OF THE INVENTION

The pilots, aircrew and passengers of today's military and commercial aircraft are faced with a substantial threat of head and cervical spine injuries. For example, the recent addition of strengthened airframes, ruggedized fuel cells, energy absorbant landing gear and load limiting seats in the various helicopters have made approximately 80% of crashes potentially survivable, according to published data. The primary remaining hazard is cockpit strikes. Insufficient cockpit room for crew displacement, protruding controls and cockpit panels are the current threat to aircrew. Sixty-five percent of 153 projected deaths in a specific helicopter program will be from cockpit strikes, resulting in medical expenses and crew replacement costs in excess of $21 million. Even a properly maintained and adjusted restraint system experiences slack and elongation—the cause of cockpit injuries.

In the case of serious injury, broken jaws, etc., a crew member might be rendered unconscious, thereby unable to depart from the wrecked vehicle. Additionally, flailing of the head in a crash situation often causes debilitation head and cervical injury.

SUMMARY OF THE INVENTION

It is an object of the invention to provide additional head and cervical support in a potential cockpit situation and to eliminate head flailing.

It is a further object of the invention to provide a restraining inflatable neck guard which can be used as a supplemental head/cervical restraint system in conjunction with existing flight gear and restraint systems and which attaches directly to the vest or other clothing.

The neck guard is triggered inertially to inflate in the event of vehicle accident or rapid acceleration/deceleration. In addition, the neck guard can be operated manually, as in the case of parachuting or transporting.

The neck guard of the invention will provide substantially increased pilot/crew survivability while allowing and supporting newer, heavier helmet systems while providing a minimum weight increase to existing restraint systems.

Unlike conventional airbag systems, the invention is completely self-contained, requiring no pilot-vehicle interface, yet does not interfere in any way with pilot/-crew functions, before deployment. But, this can also use aircraft systems if required for function.

Implementation of the invention will provide protection to pilots, air crew and passengers of commercial and military type vehicles. It can also be used to provide protection against head and cervical injuries/complications associated with a variety of sports, automobile, and industrial accidents while the patient is being transported or otherwise engaged during the recovery period.

In the embodiment disclosed, the restraining inflatable neck guard apparatus comprises an inflatable member adapted to be located around a person's neck which, upon inflation will expand and assume the designed shape through the utilization of internal shape molding spars and strength bars. This produces controlled inflation as not developed before. A source of compressed gas is coupled to the inflatable member for inflation. A normally closed electrically actuated valve is provided for releasing the compressed gas from the source for flow to the inflatable member when actuated. Sensing means, for example, from aircraft is provided for sensing acceleration and deceleration forces for producing an electrical output having a level which is a function of the force sensed. In addition, a threshold device is provided and which is responsive to the electrical output for actuating the valve when the electrical output reaches a predetermined level. Also, these functions can be initiated by aircraft systems.

In the preferred embodiment, the sensing means is of the type that senses acceleration and deceleration forces in three mutually perpendicular directions.

The restraining inflatable neck guard can be used with a unidirectional accelerometer for egress function/ejection where it is important to sense the ejection only to prevent cervical compression and then flailing in the high speed air.

For manual actuation of the valve, the sensing means and threshold device will not be employed. Also, aircraft systems (vehicle systems) can be employed.

DESCRIPTION OF THE PREFERRED EMBODIMENTS

Figure 3:
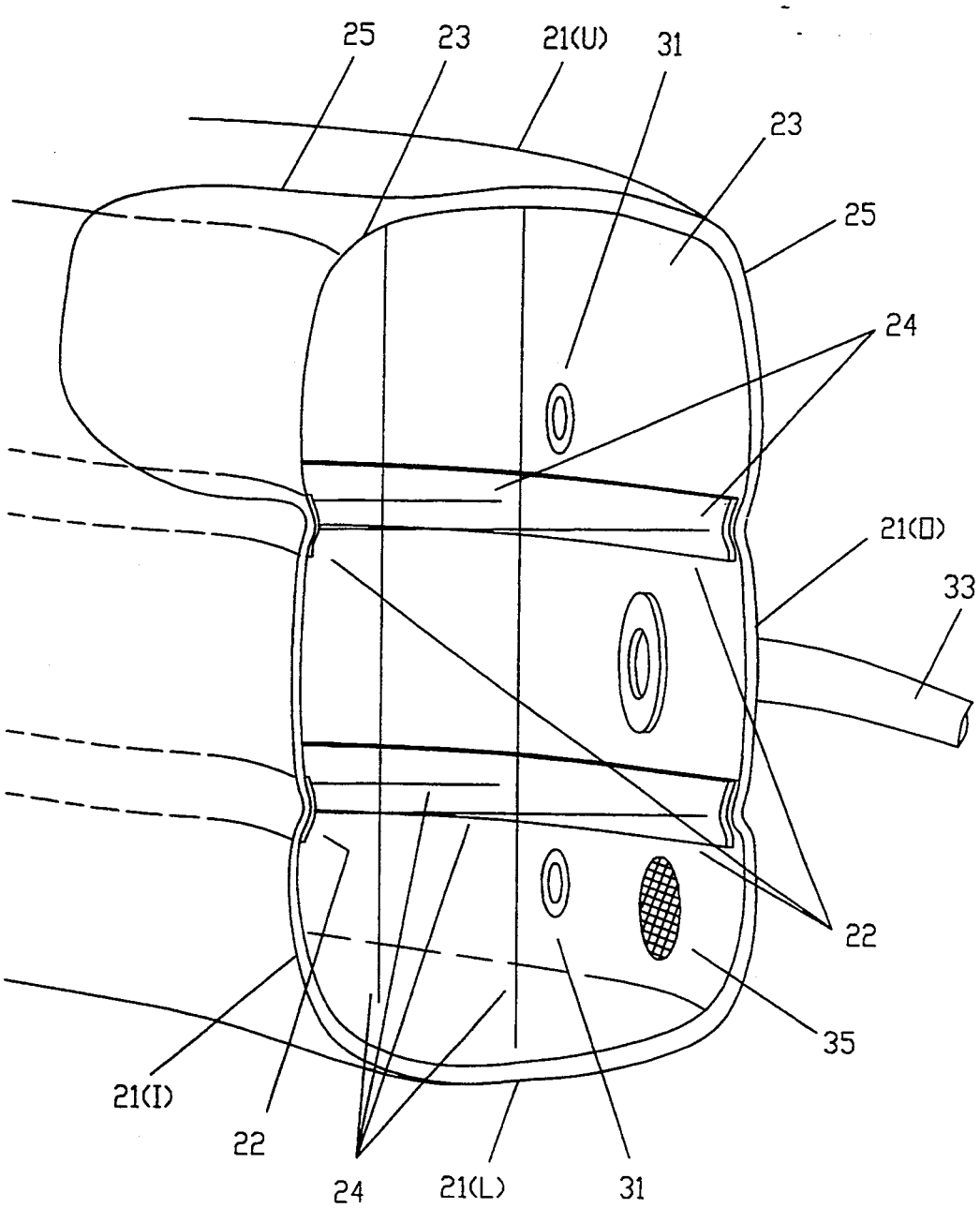
FIG. 3 is a partial cross-sectional view of the neck member of FIGS. 1 and 2, but in inflated condition.

Referring now to the drawings, the inflatable member of the apparatus of the invention is identified at 21. It comprises an elongated closed tubular member or bladder 23 formed of rubber, nylon or an elastomer with an outer cover 25 formed of a synthetic material flexible material such as NOMEX. One end of the member 21 has a tab 27 attached thereto such as by stitches 27T. Fasteners 29 such as snaps are secured to the tab 27. The other end of the member 21 has fasteners 31 such as snaps secured thereto such that the member 21 can be formed into a ring around the neck 121 of a person 123 with fasteners 29 and 31 secured together to secure the member 21 around the persons neck. When the member 21 is located in place around a persons neck, the stitches 27T will be located in the forward position to prevent the force of the wind from releasing the fasteners 29 which may otherwise cause the member 21 to be released from the users neck when exposed to wind, for example, upon ejection from an aircraft. The bladder 23 and the cover 25 have commercially available pressure release valves or blow out valves similar to that shown in FIG. 3 at 35 (covered by a screen) which will blow out when the pressure in the bladder reaches a given high level to deflate the bladder automatically. The member 21 has an inlet hose 33 leading to the interior of member 23 and an optional short outlet hose 35 with a manually controllable valve (commercially available) 37 leading from the interior of the member 23. If the outlet hose 35 is employed, then the blow out (as commercially available) valves will not be employed and vice versa.

Figure 1:
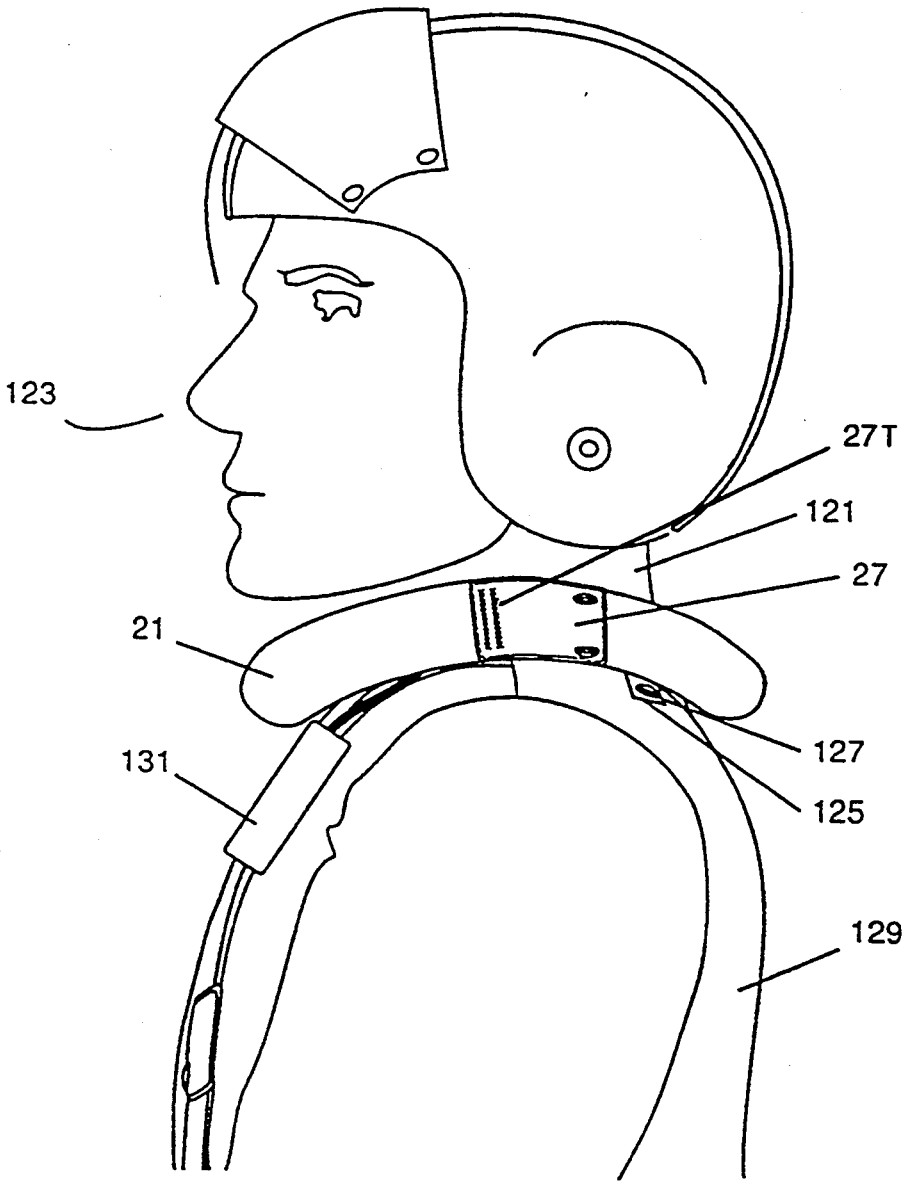
FIG. 1 illustrates the inflatable ring shaped neck member of the invention located around a person's neck in a deflated condition.
Figure 2:
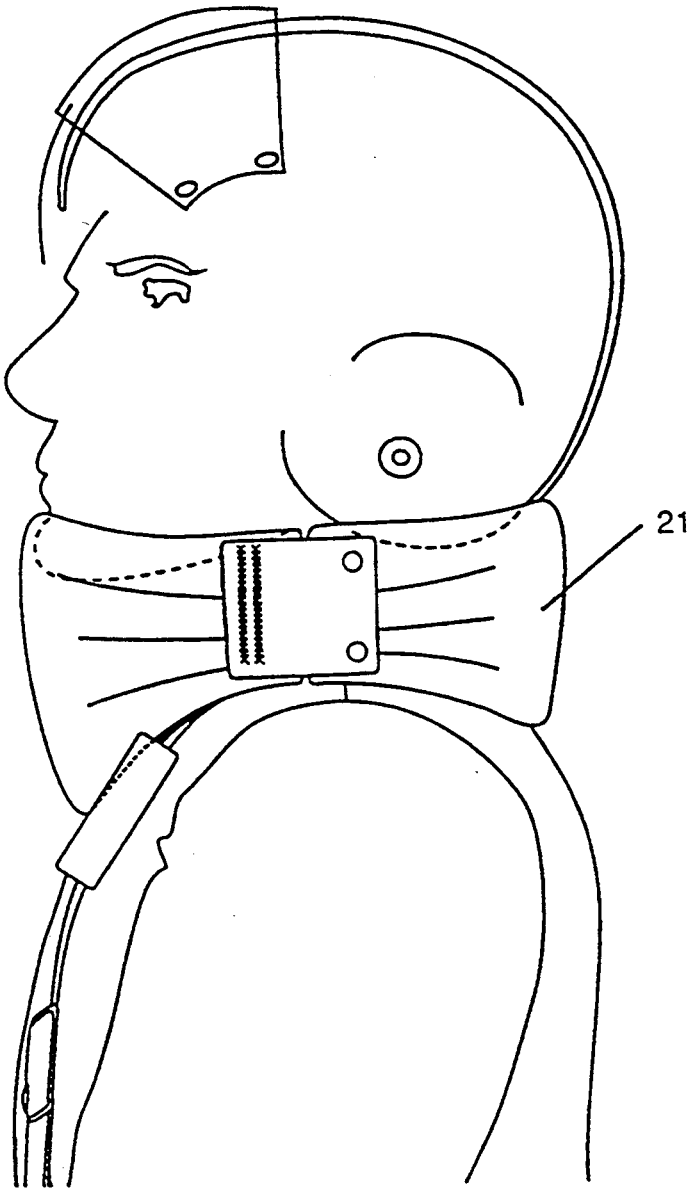
FIG. 2 is a view similar to that of FIG. 1 but with the neck member in an inflated condition.

As shown in FIG. 1, the member 21 has a tab 125 connected thereto with fasteners such as snaps 127 to allow it to be secured to snaps coupled to the persons vest 129 or other clothing. The fasteners have sufficient strength to ensure secure attachment during deployment and are constructed of material that will not conduct heat sufficient to injure the wearer. The fasteners also permit easy removal or replacement of the member 21.

Rigidity of the ring member 21 is obtained through bladder pressure developed as the inner bladder 23 inflates and the integral ring member 21 takes shape; the shape of the inflatable bladder is controlled by collapsible shape molding spars 24 which are spaced intermittently throughout the length of the member. These spars 24 coupled with the strength bars 22 control the horizontal and vertical shape desired. This does not significantly restrict the inflation rate but does reduce the volume of gas required for proper inflation. The strength bars 22 are formed of strips of reinforced flexible bladder material secured to the inside of the bladder 23 along the length thereof. The strength bars 22 may be made of the same material, or more rigid material, as that of the bladder and bonded to the inside of the bladder. As shown, two spaced apart strength bars 22 are secured to the inside of the bladder 21 on the side 21(O) that will face outward when the neck guard is located around one's neck and two spaced apart strength bars 22 are secured to the inside of the bladder on the side 21(I) that will face inward when the neck guard is located around one's neck. There are no strength bar on the upper and lower sides 21(U) and 21(L) of the neck guard.

The spars 24 may be formed of flexible filament such as fishing line and are connected at spaced apart positions to opposite side strength bars 22 along the length of the neck guard and at spaced apart positions to the inside of the upper and lower sides 21(U) and 21(L) of the bladder along its length. The members 24 may be sewn to the bars 22 and sewn to spots of additional bladder material bonded to the inside of the upper and lower sides of the inflatable member.

The spars 24 and strength bars 22 give the bladder strength and minimize expansion of the sides 21(O) and 21(I) allowing the bladder to expand more vertically than sideways. The NOMEX (or equivalent) covering 25 provides flame and fire retardation, but does not provide rigidity.

The outer cover 25 can be stitched with tear away thread or secured with VELCRO in a flattened condition while not deployed and which will allow the bladder to be inflated when the valve 81 is actuated.

The member 21 can be inflated by injecting compressed gas into the tubular member 23 and optionally deflated by opening valve 37 (commercially available).

The apparatus for inflating the member 23 comprises an inertia force sensing device 41, a voltage threshold circuit 51 powered by a battery 71 when the switch 73 is closed, a normally closed valve 81, and a source 91 of compressed inert gas such as nitrogen. The sensing device 41 produces an electrical output representative of the acceleration/deceleration forces sensed. When the electrical output reaches a predetermined level, the circuit 51 actuates the valve 81 to release the gas from the source 91 for flow into the bladder of the member 21 to inflate the member 21.

Member 61 is a voltage sense detector which will indicate when the battery is low. The circuit lights a LED 61D2 when voltage V2 is below voltage V3 of Zenor diode 61D1. When voltage V2 is below V3, a unijunction transistor 61Q1 is activated which allows current to flow and turn on LED 61D2. When voltage V2 is greater than voltage V3, the Zenor diode 61D1 conducts, not allowing the unijunction transistor 61Q1 to activate via LED 61D2.

In the preferred embodiment the device 41 is a multidirectional accelerometer that has three accelerometers 41X, 41Y, and 41Z in a single housing which are accurately aligned, such that acceleration/deceleration in three mutually perpendicular directions X, Y, and Z can be sensed and measured. The accelerometer is a self-generating device which produces three independent electrical outputs on leads 41L1, 41L2, and 41L3 which are proportional in magnitude to the forces sensed along the directions X, Y, and Z. The three independent electrical outputs on leads 41L1, 41L2, and 41L3, of the accelerometer 41 are applied to the non-inverting amplifiers 51A1, 51A2, and 51A3 of the threshold device 51 which is battery-powered electronic circuit that detects applied voltages from the sensor 41. The three independent non-inverting amplifiers 51A1, 51A2, and 51A3 receives the applied voltages and amplifies them. The voltage outputs of the three independent non-inverting amplifiers 51A1, 51A2, and 51A3 are applied to three independent voltage comparators 51B1, 51B2, and 51B3 respectively each of which compares the amplified signals with a threshold voltage. For each comparator, if the voltage of the amplified signal is greater than the threshold voltage, the output of the comparator changes state. If the voltage of the amplified signal is less than the threshold voltage, the output of the comparator does not change state. The outputs of the voltage comparators 51B1, 51B2, and 51B3 are applied to latch devices 51C1, 51C2, and 51C3. The outputs of latch devices 51C1, 51C2, and 51C3 are applied to a lead 53 which is coupled to a transistor driver 55. The voltage output on lead 57 of the driver 55 is applied to the valve 81 to actuate the valve and allow the compressed gas of the source 91 to flow into the ring shaped member 23 by way of hose 33. When the output of a comparator changes state the associated latch circuit detects that change and activates the transistor driver circuit 55 to actuate the valve 81. This latch circuit is designed to not change states unless power is cycled "off" and "on". Once the base input of the transistor 55 is activated, the output of the transistor applies a voltage to activate the valve 81. The purpose of the transistor driver is to supply current for a specific time period.

The components 41, 51, 61, 71, 73, 75, 77, 81, and 91 are located in a container 131 and is attached to the vest 129 or clothing by suitable fasteners such as snaps.

The sensor 41 recognizes rapid, changes in vehicle speed and provides actuation of the gas source or cylinder 91 to inflate the bladder 23.

At the moment of impact (triggering) acceleration or deceleration, or upon manual activation, the ring member 21 inflates completely to support the head and neck. The gas cylinder 91 contains sufficient volume of inert gas such as nitrogen to fill the internal bladder 23 upon deployment. When actuated by the acceleration/deceleration sensor 41, the inert gas is supplied under pressure via the tube 33, to inflate the internal bladder 23.

The valve assembly 81 provides one-way inert gas release from the gas cylinder 91, through the tube 33 to the expandable bladder 23.

Once inflated, the ring assembly 21 forms a semi-rigid structure that eliminates stress on the head and cervical spine area during multi-directional acceleration or deceleration. The ring assembly 21 should weigh less than 15 oz. The guard 21 optionally can be deflated by manually opening valve 37.

In one embodiment, the sensor 41 may be a Bruel and Kjaer type 4321 type sensor. Accelerometers of this type are disclosed in "Piezoelectric Accelerometer and Vibration Preamplifier Handbook" by Mark Serridge and Torben R. Licht, October 1986. The valve 81 is a two-way, normally closed device that controls the flow of the inert gas contained in the pressurized cartridge. The valve 81 may be a solenoid actuated valve similar to a FutureCraft Corp. P/N 200878-1 solenoid type valve. The solenoid will be actuated by the signal on lead 57 to open the valve rapidly. The valve 81 also may be an explosive/squib type valve similar to a FutureCraft Corp. P/N 3824A-A-10 squib type explosive valve actuated by an electrical signal to cause the valve to open rapidly. A valve of this type is disclosed in U.S. Pat. No. 3,017,894 which is incorporated herein by reference. The cartridge 91 will be replaceable after used. Switch 73 is a single-throw (on/off) for supplying power to the voltage Threshold Detector/Driver 51 for ensuring safety of the ring assembly 21 during shipment and handling.

Figure 4:
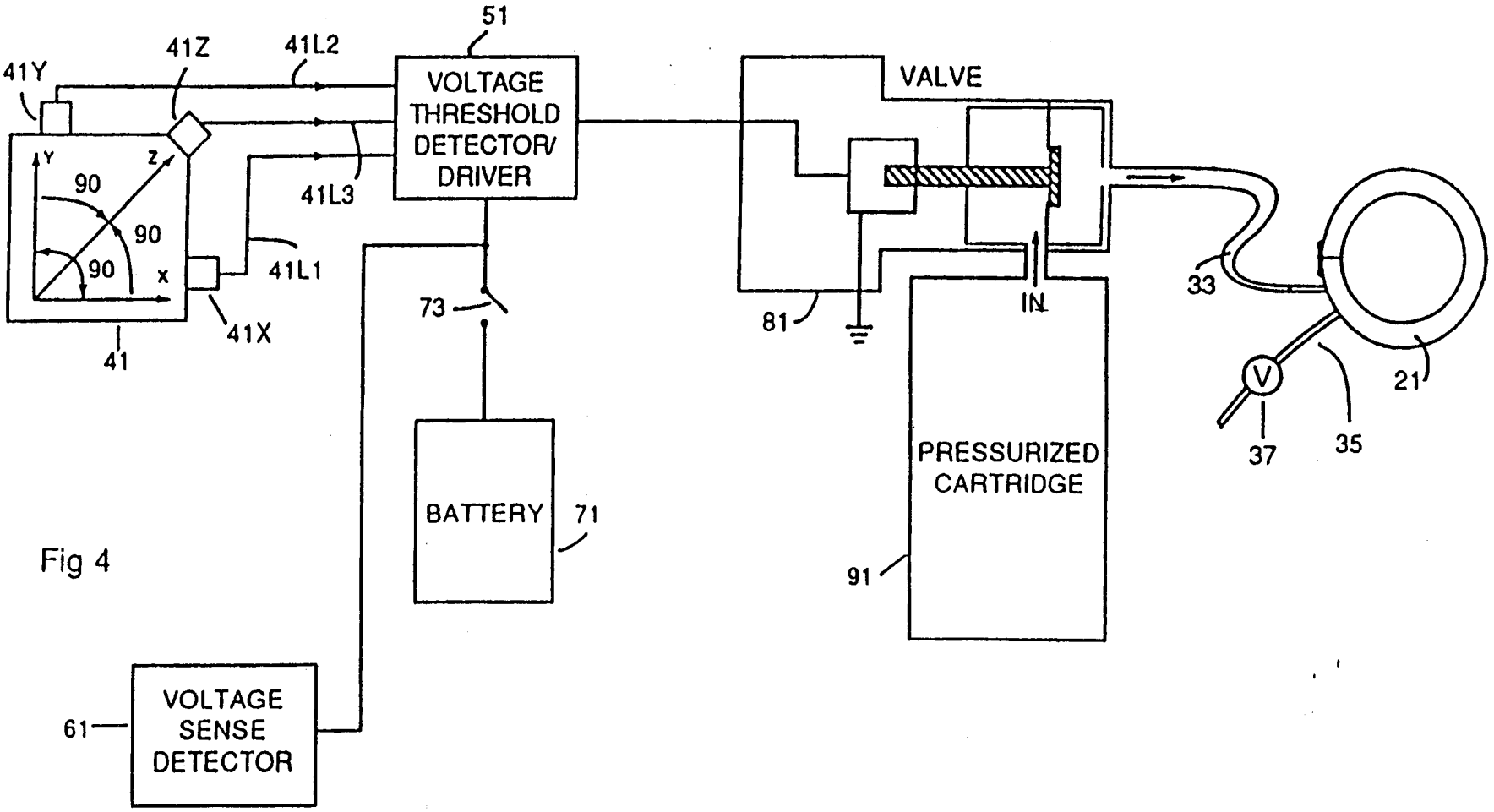
FIG. 4 schematically illustrates components of the neck guard, and supporting system.
Figures 5, 6:
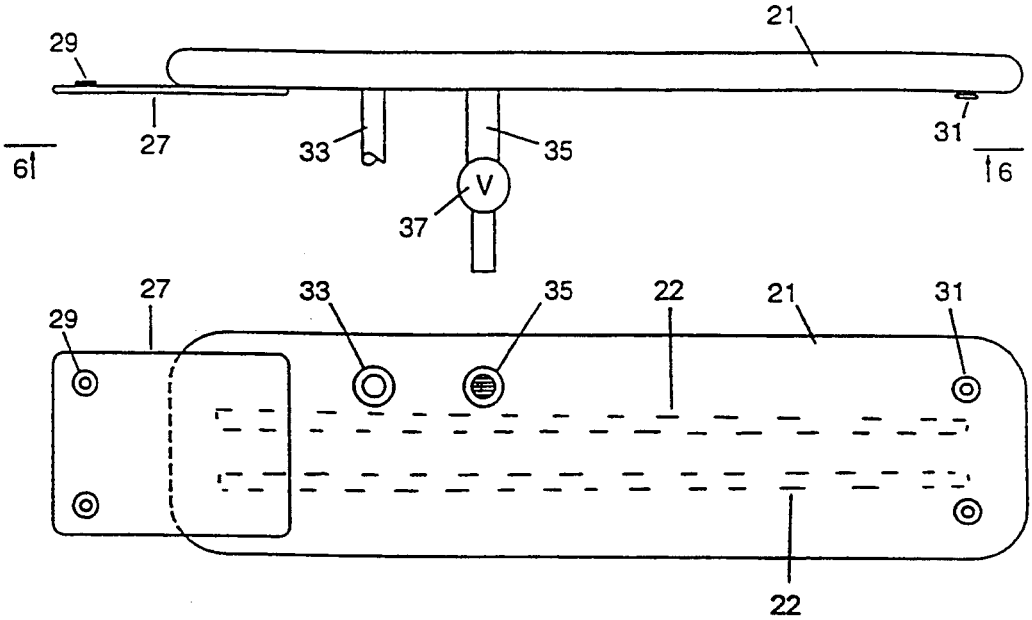
FIG. 5 is an edge view of the neck guard in an elongated position and deflated condition.
FIG. 6 is a side view of FIG. 5 taken along lines 6—6 thereof.
Figure 7:
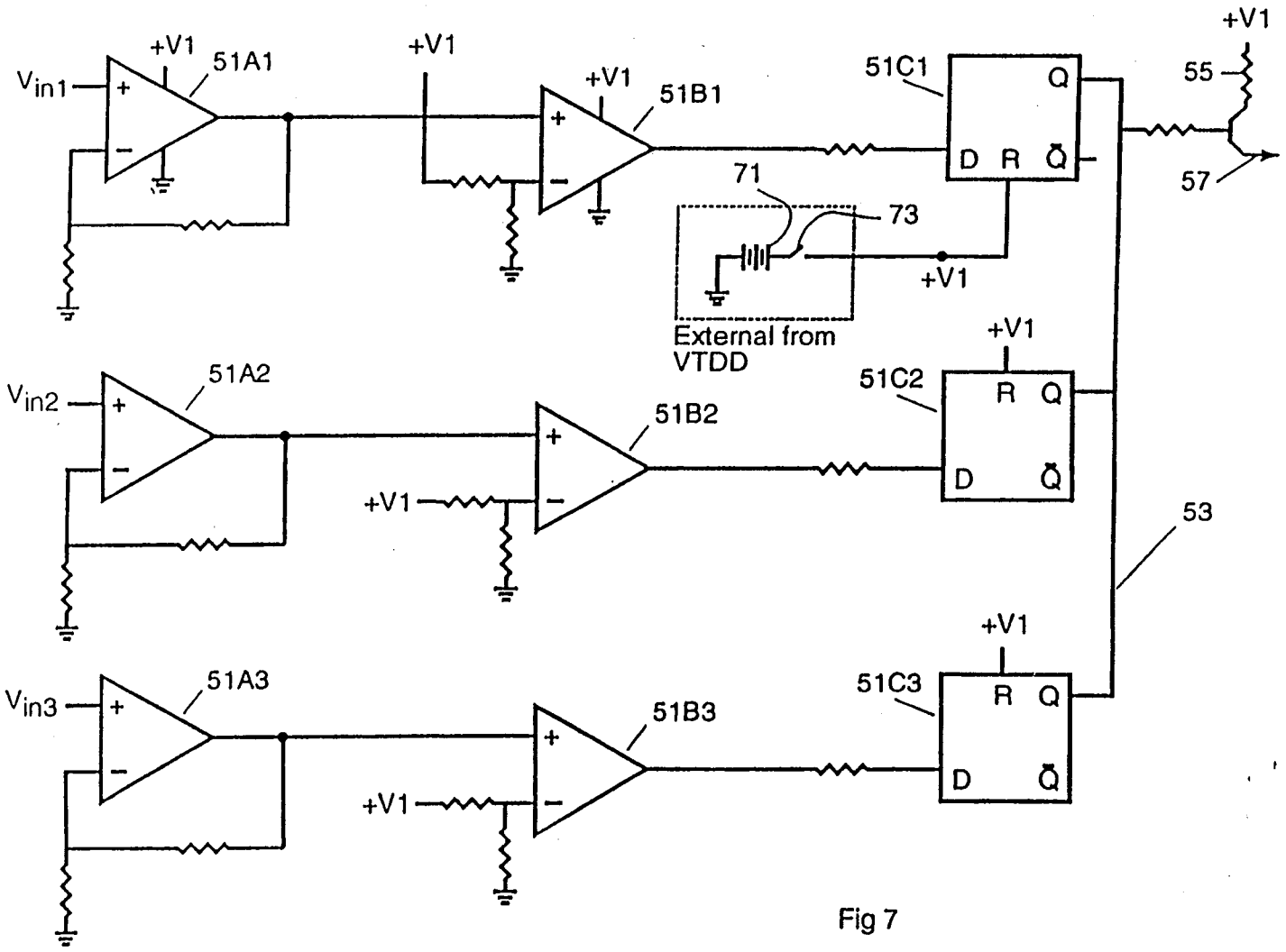
FIG. 7 is an electrical schematic of the voltage threshold detector/driver of the system of FIG. 4.
Figure 8:
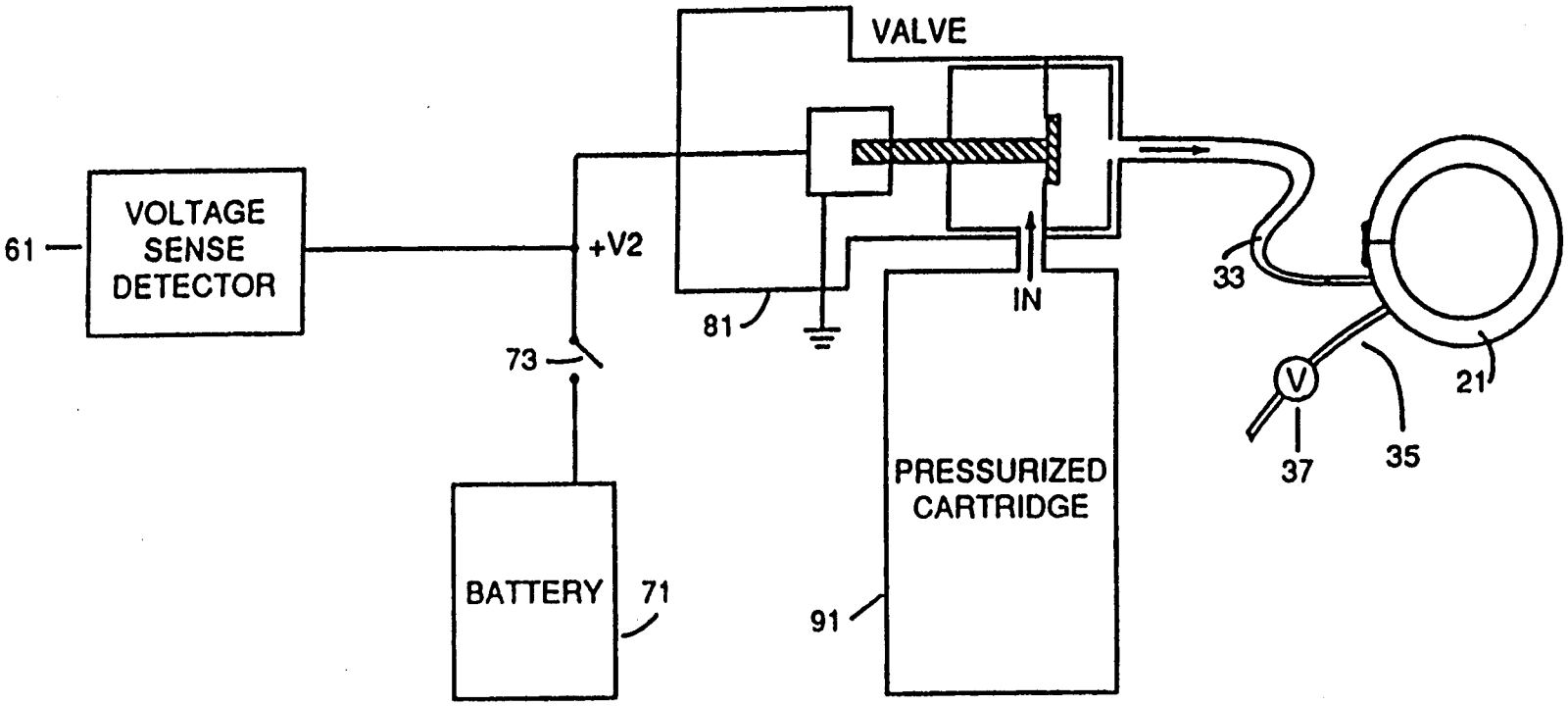
FIG. 8 is a modification of the device of FIG. 4 for use for manual actuation.
Figure 9:
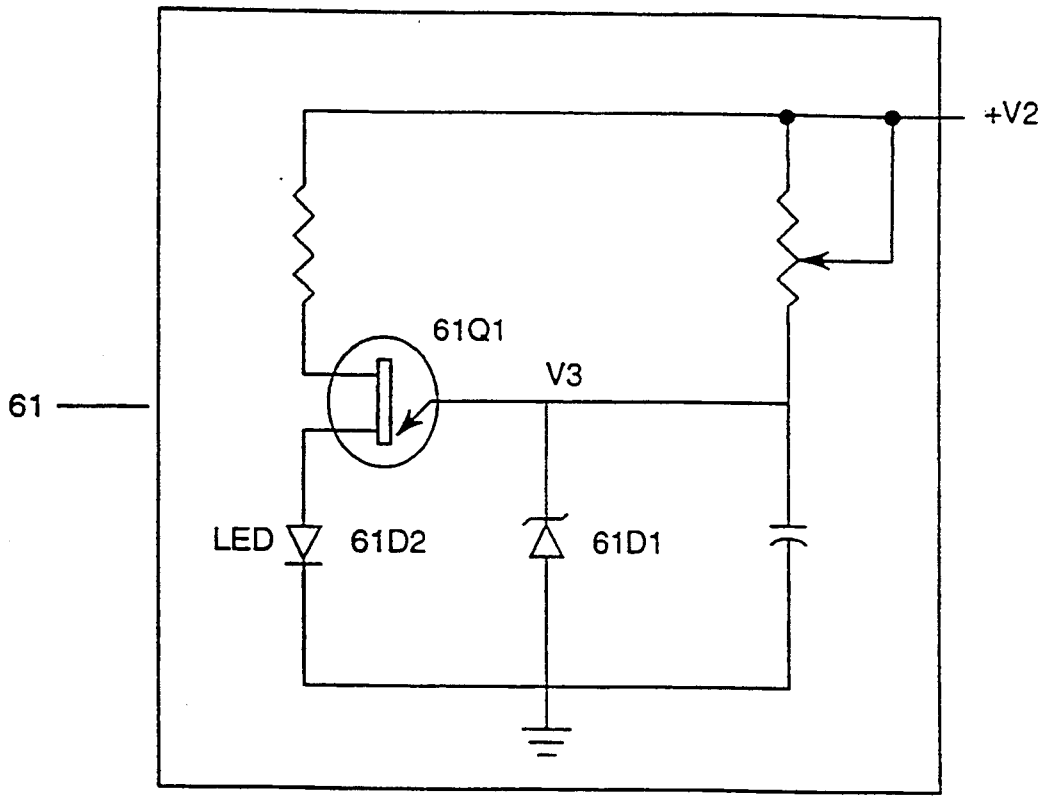
FIG. 9 is an electrical schematic of a voltage sensing detector.
Figure 10:
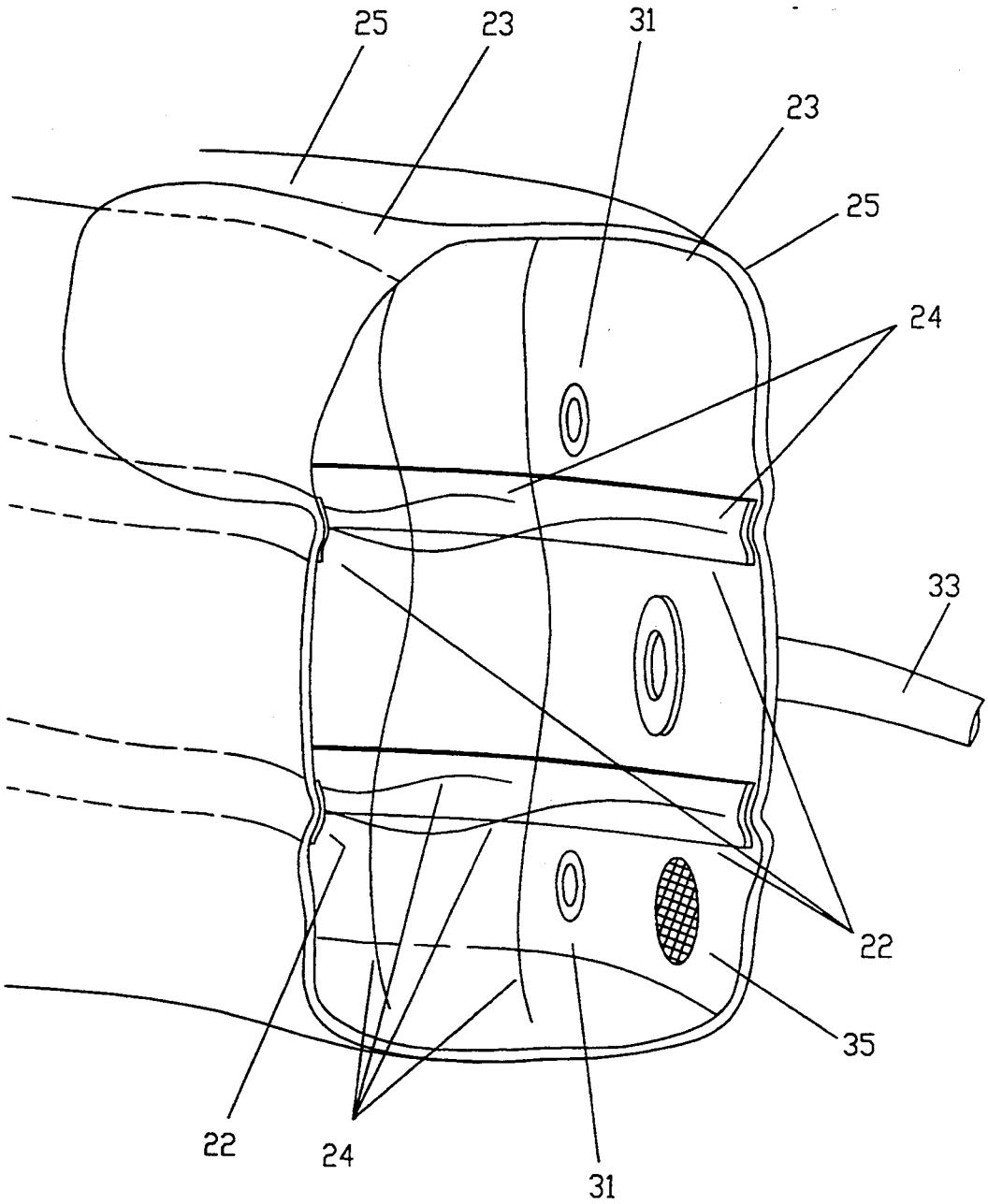
FIG. 10 is a partial cross-sectional view of the neck member of FIGS. 1 and 2, but in partial deflated condition.

In order to inflate the ring-shaped member 21 manually, for example to provide support for one's neck and head for parachuting purposes, the embodiment of FIG. 8 will be employed. This embodiment is the same as that of FIG. 4 except that components 41 and 51 are not employed. The valve 81 will be activated when switch 73 is closed.

If the sensor 41 is to be used as a unidirectional accelerometer, the voltages of only one of the comparators 51B1, 51B2, 51B3 will be adjusted for operation whereby only its accelerometer will be employed to actuate the system for inflating the device 21 when the forces it senses in its sensitive direction reaches a certain level. This inflatable collar can be used with aircraft or vehicle systems to initiate the inflation sequence.

It is to be understood that the invention also has commercial application for participants for sports such as auto racing, boat racing and motorcycle racing. It can also be used by jockeys in horse racing or polo players wherein the manually actuated embodiment is employed.

I claim:

1. A restraining inflatable neck guard apparatus, comprising:

an inflatable member adapted to be located around a person's neck, said inflatable member comprises an elongated member having opposite ends with fastening means at said opposite ends for fastening said opposite ends together to form a ring-shaped member around a person's neck, said inflatable member when its opposite ends are fastened together has inner and outer sides and upper and lower sides, elongated flexible reinforcing means secured to the inside of said outer side and to the inside of said inner side, said elongated reinforcing means extend along the length of said inflatable member, a plurality of flexible members, each of which has opposite ends connected to said inner and outer sides respectively of said inflatable member on the inside thereof such that said flexible members extend between said inner and outer sides on the inside of said inflatable member, said reinforcing means and said flexible members minimizing the expansion of said inflatable member between said inner and outer sides and allowing increased expansion of said inflatable member between said upper and lower sides, a source of compressed gas coupled to said inflatable member for inflating said inflatable member, a normally closed electrically actuated valve for releasing said compressed gas of said source for flow to said inflatable member when actuated, and means for actuating said valve.

2. A restraining inflatable neck guard apparatus, comprising:

an inflatable member adapted to be located around a person's neck, said inflatable member comprises an elongated member having opposite ends with fastening means at said opposite ends for fastening said opposite ends together to form a ring-shaped member around a person's neck, said inflatable member when its opposite ends are fastened together has inner and outer sides and upper and lower sides, elongated flexible reinforcing means secured to the inside of said outer side and to the inside of said inner side, each of said elongated reinforcing means has a given width and a given length and extends along the length of said inflatable member, the width of each of said elongated reinforcing means is substantially less than the dimension of said inflatable member between said upper and lower sides, a plurality of flexible members, each of which has opposite ends connected to said inner and outer sides respectively of said inflatable member on the inside thereof such that said flexible members extend between said inner and outer sides on the inside of said inflatable member, said reinforcing means and said flexible members minimizing the expansion of said inflatable member between said inner and outer sides and allowing increased expansion of said inflatable member between said upper and lower sides, a source of compressed gas coupled to said inflatable member for inflating said inflatable member, a normally closed electrically actuated valve for releasing said compressed gas of said source for flow to said inflatable member when actuated, sensing means for sensing acceleration and deceleration forces and for producing an electrical output having a level which is a function of the force sensed, and a threshold device responsive to said electrical output for actuating said valve when said electrical output reaches a predetermined level.

3. The restraining inflatable neck guard apparatus of claim 2, wherein:

said sensing means senses acceleration and deceleration forces in three mutually perpendicular directions and produces said electrical output which is a function of the forces sensed.

4. The apparatus of claim 1, wherein:

said source of compressed gas comprises a container for holding said compressed gas and which is releasable upon actuation of said valve.

5. The application of claim 1, wherein:

said fastening means comprises a first fastener secured to one end of said elongated member, a tab attached to the other end of said elongated member at a given position by attaching means and having a free end with a second fastener secured to said free end of said tab for removable attachment to said first fastener whereby said inflatable member may be located and secured around a person's neck with said attaching means located on the side of the person's neck and forward of said first and second fasteners.

6. The apparatus of claim 4, comprising:

a tube for coupling said container to said inflatable member, and enclosure means for holding said container and said valve at a position exterior of said inflatable member for attachment to the user's clothing.

7. The apparatus of claim 4, comprising:

said fastening means comprises a first fastener secured to one end of said elongated member, a tab attached to the other end of said elongated member at a given position by attaching means and having a free end with a second fastener secured to said free end of said tab for removable attachment to said first fastener whereby said inflatable member may be located and secured around a person's neck with said attaching means located on the side of the person's neck and forward of said first and second fasteners.

8. The apparatus of claim 4, comprising:

a tube for coupling said container to said inflatable member, and enclosure means for holding said container and said valve at a position exterior of said inflatable member for attachment to the user's clothing.

9. The apparatus of claim 7, comprising:

a tube for coupling said container to said inflatable member, and enclosure means for holding said container and said valve at a position exterior of said inflatable member for attachment to the user's clothing.

10. The apparatus of claim 9, comprising:

means for releasing gas from said inflatable member when the pressure therein reaches a given level.

11. The apparatus of claim 2, wherein:

said source of compressed gas comprises a container for holding said compressed gas and which is releasable upon actuation of said valve.

12. The apparatus of claim 2, wherein:

said fastening means comprises a first fastener secured to one end of said elongated member, a tab attached to the other end of said elongated member at a given position by attaching means and having a free end with a second fastener secured to said free end of said tab for removable attachment to said first fastener whereby said inflatable member may be located and secured around a person's neck with said attaching means located on the side of the person's neck and forward of said first and second fasteners.

13. The apparatus of claim 11, comprising:

a tube for coupling said container to said inflatable member, and holding means for holding said sensing means, said valve, and said container at a position exterior of said inflatable member for attachment to the user's clothing.

14. The apparatus of claim 13, comprising:

electrical amplifier means coupled from said sensing means to said electrically actuated valve, said amplifier means being supported by said holding means.

15. The apparatus of claim 11, comprising:

said fastening means comprises a first fastener secured to one end of said elongated member, a tab attached to the other end of said elongated member at a given position by attaching means and having a free end with a second fastener secured to said free end of said tab for removable attachment to said first fastener whereby said inflatable member may be located and secured around a person's neck with said attaching means located on the side of the person's neck and forward of said first and second fasteners.

16. The apparatus of claim 11, comprising:

a tube for coupling said container to said inflatable member, holding means for holding said sensing means said valve and said container at a position exterior of said inflatable member for attachment to the user's clothing, electrical amplifier means coupled from said sensing means to said electrically actuated valve, and said amplifier means being supported by said holding means.

17. The apparatus of claim 15, comprising:

a tube for coupling said container to said inflatable member, holding means for holding said sensing means, said valve, and said container at a position exterior of said inflatable member for attachment to the user's clothing, electrical amplifier means coupled from said sensing means to said electrically actuated valve, and said amplifier means being supported by said holding means.

18. The apparatus of claim 17, comprising:

means for releasing gas from said inflatable member when the pressure therein reaches a given level.

19. The apparatus of claim 1, wherein:

each of said elongated reinforcing means has a given width and a given length and extends along the length of said inflatable member, the width of each of said elongated reinforcing means is substantially less then the dimension of said inflatable member between said upper and lower sides.

* * * * *